US006123605A

United States Patent [19]

Yano

[11] Patent Number: 6,123,605

[45] Date of Patent: Sep. 26, 2000

[54] DRESSING DEVICE FOR CENTERLESS GRINDING MACHINE AND DRESSING METHOD FOR CENTERLESS GRINDING MACHINE

[75] Inventor: Takeshi Yano, Osaka, Japan

[73] Assignee: Koyo Machine Industries Company Ltd., Osaka, Japan

[21] Appl. No.: 09/003,037

[22] Filed: Jan. 5, 1998

[30] Foreign Application Priority Data

Feb. 20, 1997 [JP] Japan ..... 9-054042
Feb. 20, 1997 [JP] Japan ..... 9-054043

[51] Int. Cl.[7] ..... B24B 1/00; B24B 5/18

[52] U.S. Cl. ..... 451/49; 451/56; 451/72; 451/243

[58] Field of Search ..... 451/49, 51, 56, 451/72, 243

[56] References Cited

FOREIGN PATENT DOCUMENTS 60-94445 6/1985 Japan .
6-88196 11/1994 Japan .

*Primary Examiner*—Timothy V. Eley
*Attorney, Agent, or Firm*—Arent, Fox, Kintner, Plotner & Kahn

[57] ABSTRACT

A dressing device capable of effectively performing, in a centerless grinding machine, dressing to a grinding face of a grinding wheel and a rotary supporting face of a regulating wheel, performing relative positioning in axial direction of the grinding wheel and the regulating wheel after dressing, easily and accurately, and also reducing the equipment installation space. The dressing device includes a single dressing means for performing dressing to the grinding face of the grinding wheel and the rotary supporting face of the regulating wheel, this dressing structure including a rotary dresser having a profile fit for the grinding face of grinding wheel and the rotary supporting face of the regulating wheel. This makes it possible to perform dressing and truing of the grinding face and rotary supporting face accurately and at high precision regardless of the complexity or not of their profile, and any relative displacement in an axial direction between the grinding wheel and the regulating wheel are not produced in the course of dressing,. and the positioning in the axial direction of the grinding wheel and the regulating wheel after the dressing can be made easily and accurately.

15 Claims, 15 Drawing Sheets

DRESSING DEVICE FOR CENTERLESS GRINDING MACHINE AND DRESSING METHOD FOR CENTERLESS GRINDING MACHINE

BACKGROUND OF THE INVENTION

1. Field of the Invention

The present invention relates to a dressing device and a dressing method for a centerless grinding machine, more specifically to a dressing technology for either dressing or truing a grinding face of a grinding wheel and a rotary supporting face of a regulating wheel of a centerless grinding machine, efficiently and with high accuracy.

2. Description of the Related Art

A Centerless grinding machine is a system for grinding the outside cylindrical surface of a work piece (hereinafter referred to as "work") by a grinding wheel while rotatably supporting that outside cylindrical surface between the grinding wheel, a regulating wheel and a blade (bearing plate). In this centerless grinding machine, dressing by a dressing device is performed at prescribed intervals to a grinding face of the grinding wheel and a rotary supporting face of the regulating wheel, in order to constantly secure high grinding accuracy and high grinding efficiency.

A conventional centerless grinding machine was provided with special dressing devices for the grinding wheel and the regulating wheel respectively, and the dressing of the grinding face of the grinding wheel and that of the rotary supporting face of regulating wheel used to be performed independently of each other.

Moreover, said two dressing devices were provided on the opposite sides of the grinding position i.e. on the outsides of the grinding wheel and the regulating wheel respectively, not to disturb the grinding by the grinding wheel and the regulating wheel.

However, such a conventional construction has presented the following problems and there has been a desire for improvement about the construction of this point:

(1) Equipment cost of the grinding machine increases due to necessity of two dressing devices.

(2) The grinding machine increases in size and complicates in structure, because installation spaces of said two dressing devices are provided on the outsides of the grinding wheel and the regulating wheel respectively.

(3) In a radial feed type centerless grinder, relative positioning in axial direction of the grinding wheel and the regulating wheel is extremely important, because the grinding face of the grinding wheel and the rotary supporting face of the regulating wheel have a profile fit for the outside cylindrical surface of the work. However, with a construction in which the dressing is performed individually on the grinding wheel side and the regulating wheel side as described above, this relative positioning in the axial direction becomes difficult, taking lots of time for the change of the setup, etc. This problem was conspicuous especially in a case where said grinding face and rotary supporting face have a complicated profile.

BRIEF SUMMARY OF THE INVENTION

The main object of the present invention is to provide a novel dressing device of a centerless grinding machine solving such problems of conventional systems.

Another object of the present invention is to provide a dressing device capable of efficiently performing, on a centerless grinding machine, dressing to a grinding face of a grinding wheel and a rotary supporting face of a regulating wheel.

Still another object of the present invention is to provide a dressing device capable of performing relative positioning in an axial direction of the grinding wheel and the regulating wheel after dressing, easily and accurately.

Yet another object of the present invention is to provide a dressing device capable of reducing the equipment installation space.

Still another object of the present invention is to provide a dressing method for efficiently performing dressing to a grinding face of a grinding wheel and a rotary supporting face of a regulating wheel of a centerless grinding machine, by using said dressing device.

The dressing device of the present invention is constructed by comprising a single dressing structure for performing dressing to a grinding face of a grinding wheel and a rotary supporting face of a regulating wheel. As a preferred embodiment, said dressing structure is realized by comprising a rotary dresser having a profile fit for the grinding face of the grinding wheel and the rotary supporting face of the regulating wheel.

Moreover, the dressing method for the centerless grinding machine according to the present invention, which is executed by using the dressing device, consists in either dressing the grinding face of the grinding wheel and the rotary supporting face of the regulating wheel at the same time or dressing the grinding face of the grinding wheel and the rotary supporting face of the regulating wheel independently of each other.

In the present invention, dressing is performed to the grinding face of the grinding wheel and the rotary supporting face of the regulating wheel at proper intervals respectively, and this dressing is executed by the single dressing system provided with a rotary dresser having a profile fit for the grinding face of the grinding wheel and the rotary supporting face of the regulating wheel. Accordingly, perform dressing and truing of the grinding face and the rotary supporting face are performed accurately regardless of the complexity or not of their profiles and without producing any relative displacement in an axial direction between the grinding wheel and the regulating wheel is not produced in the course of the dressing, thereby facilitate and ascertain the positioning in the axial direction of the grinding wheel and the regulating wheel after dressing.

Furthermore, by performing said dressing to the grinding face of the grinding wheel and the rotary supporting face of the regulating wheel at the same time, it becomes possible to effectively prevent clogging of the rotary dresser, thus enabling efficient dressing.

Namely, in the case where dressing by the rotary dresser is made only to the rotary supporting face of the regulating wheel, the dressing face of the rotary dresser is liable to be clogged, because binder for the abrasive grains constituting said rotary supporting face is of comparatively high viscosity and soft. On the other hand, simultaneous dressing of the grinding face of the grinding wheel and, the rotary supporting face of the regulating wheel produces a dressing effect to the rotary dresser and a clogging preventive effect with the abrasive grains on the grinding wheel side, etc., thus effectively preventing clogging of the regulating wheel and improving the dressing performance.

This and other related objects and characteristics of the present invention will become apparent with reading of the detailed explanation based on the attached drawings and the novel matters thereof claimed in the claims.

BRIEF DESCRIPTION OF THE DRAWINGS

FIG. 10(*b*) is a plan view showing double conical rollers which are the object of grinding of the centerless grinding machine.

FIG. 11(*b*) is a perspective view showing the state of rolling motion of the double conical rollers in the scroll type compressor.

DETAILED DESCRIPTION OF THE PREFERRED EMBODIMENTS

Figure 1:
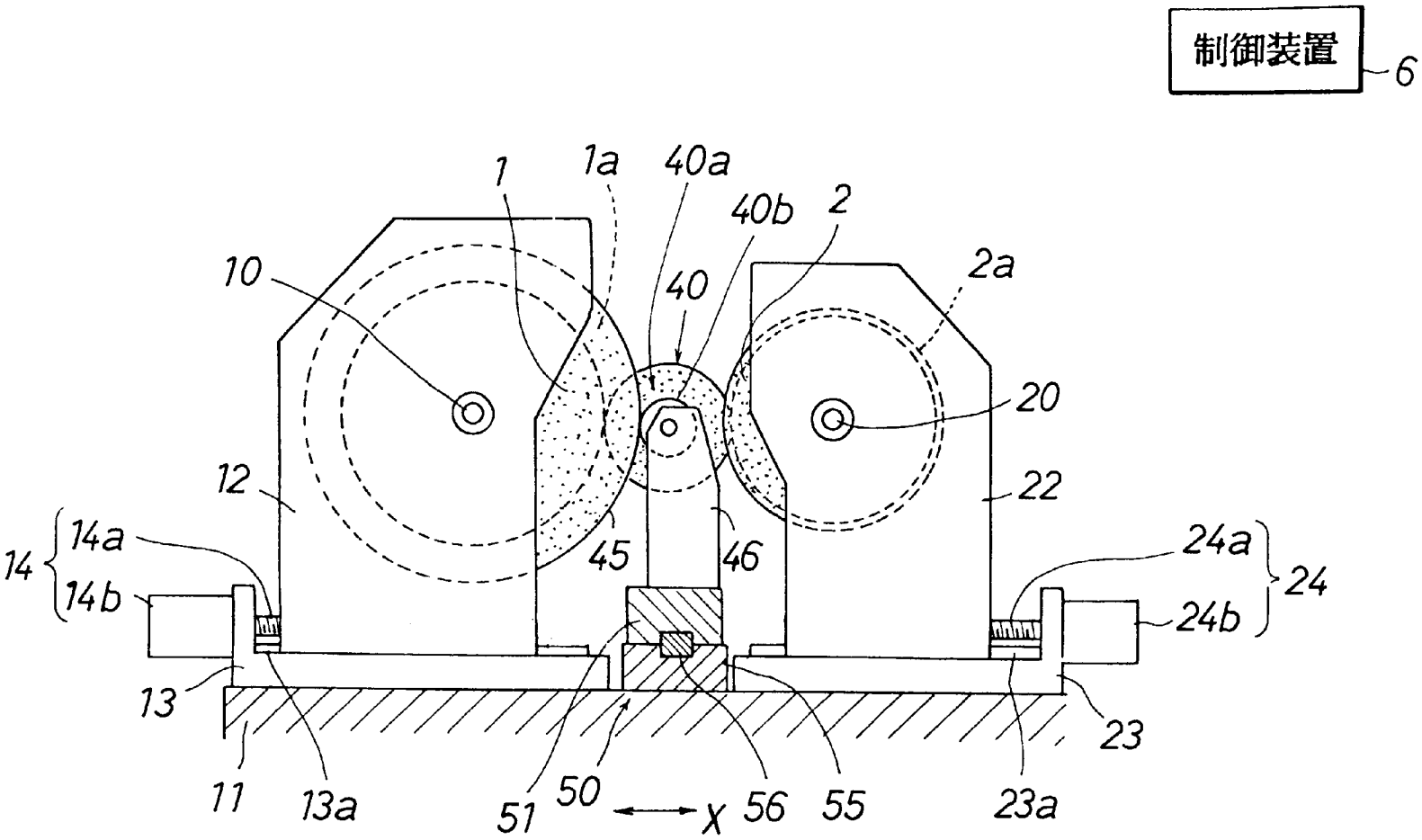
FIG. 1 is a front elevation showing a centerless grinding machine provided with a dressing device which is the first embodiment of the present invention, and indicates the state in which both the grinding wheel and the regulating wheel are dressed simultaneously by means of a single rotary dresser.
Figure 2:
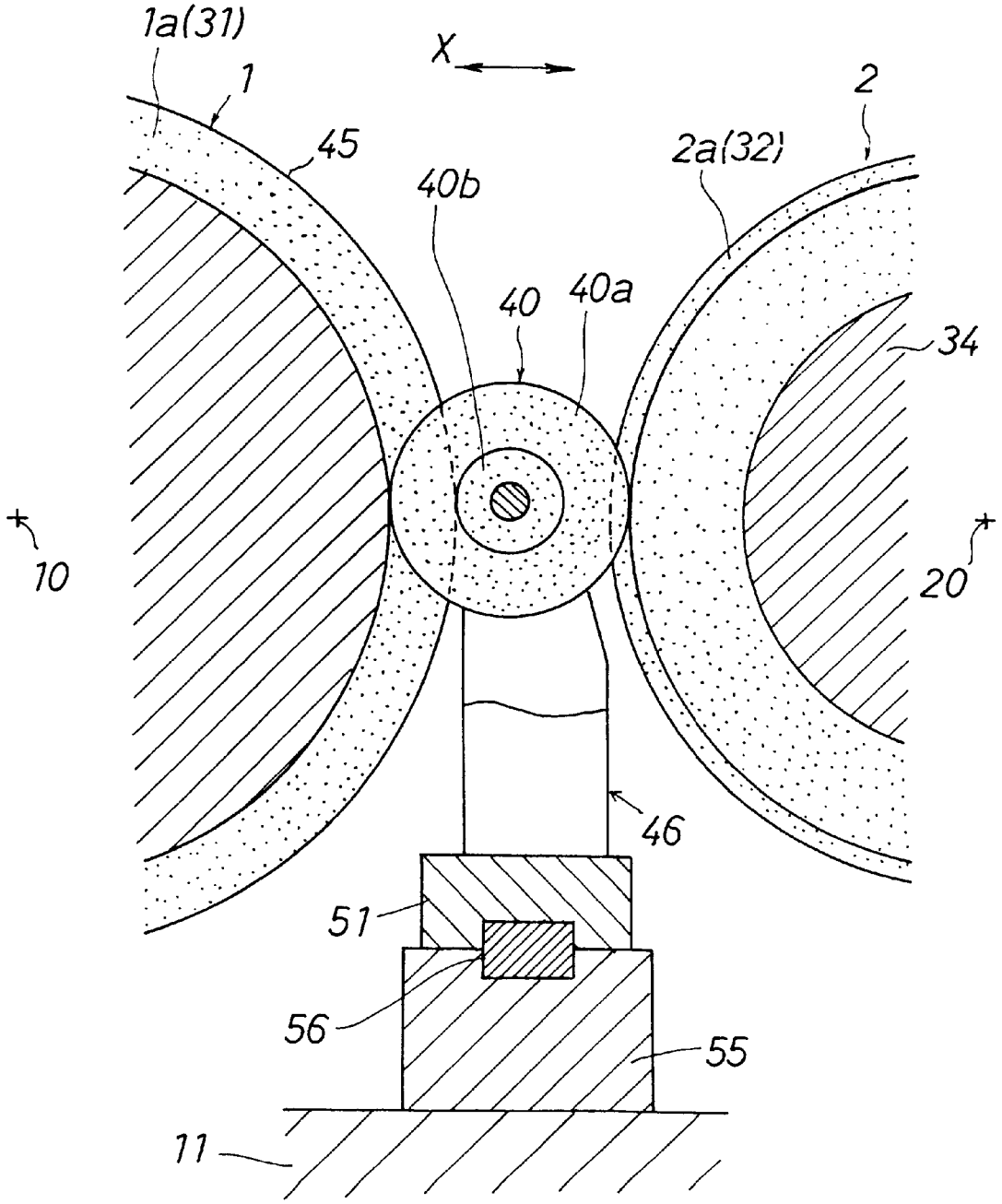
FIG. 2 is an expanded front elevation showing the main part of the dressing device in the centerless grinding machine, by partially breaking that part.

Embodiments of the present invention will be explained hereafter based on the drawings.

Embodiment 1

FIG. 1 to FIG. 9 indicate a centerless grinding machine provided with a dresser according to the present invention. In all the drawings, one same reference numeral or symbol indicates one same component member or element.

Figure 10A:
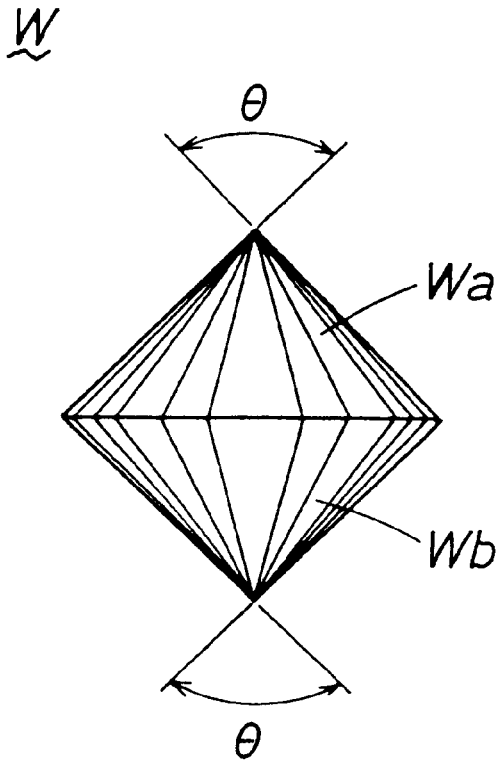
FIG. 10(*a* ) is a front elevation showing double conical rollers which are the object of grinding of the centerless grinding machine.
Figure 10B:
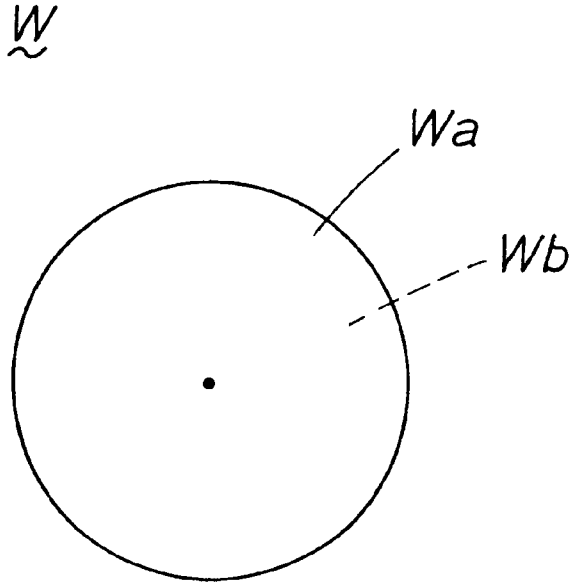

This centerless grinding machine is designed for simultaneously grinding, to be specific, the double conical faces (outside cylindrical surfaces) Wa, Wb of a plural number (three in the illustrated case) of double conical rollers (works) W, W, . . . as indicated in FIG. 10(*a*) and FIG. 10(*b*) by radial feed grinding system, while rotatably supporting the works W, W,. . . collectively at a grinding position A.

The centerless grinding machine, provided with a grinding wheel 1, a regulating wheel 2, a blade 3 and a loader unit 4 as basic components, comprises a single dresser 5 for dressing the grinding wheel 1 and the regulating wheel 2 and is constructed in such a way that those component units 1 to 5 are automatically controlled by a controller 6.

Moreover, the double conical roller as the work W has, in the front face shape as indicated in FIG. 10(*a*), an angles formed by the top and bottom vertices i.e. conical angles θ are set at 90°, and therefore a crossed axes angle of the double conical faces Wa, Wb is also set at 90°.

The grinding wheel 1 is intended for grinding the outside cylindrical surface of the works W, W, . . . . The rotating spindle 10 of the grinding wheel 1, provided with a general basic structure of public knowledge, is rotatably mounted on a grinding wheel base 12 provided on the equipment bed 11 and is connected to a drive source such as non-illustrated drive motor, etc.

Furthermore, the grinding wheel base 12 is movable in two ways in the radial feed direction X along a slide rail 13*a* on a slide base 13 provided on the equipment bed 11, and is connected to a feed screw unit 14.

This feed screw unit 14, designed for moving the grinding wheel base 12, comprises a feed screw mechanism 14*a* such as ball screw, etc. connected to the grinding wheel base 12 in a way to screw and move forward and backward, and a servo motor 14*b* for rotating and driving this feed screw mechanism 14*a*. This servo motor 14*b* is placed on the slide base 13, and is connected electrically to the controller 6.

The regulating wheel 2 is intended to rotatably support the outside cylindrical surface of the works W, W, . . . . The rotating spindle 20 of the regulating wheel 2 is, in the same way as said grinding wheel 1, provided with a general basic structure us well-known, rotatably mounted on a regulating wheel base 22 provided on the equipment bed 11 and connected to a drive source such as non-illustrated drive motor, etc.

Moreover, the regulating wheel base 22 is movable in two ways in the radial feed direction X along a slide rail 23*a* on a slide base 23 provided on the equipment bed 11, and is connected to a feed screw unit 24.

This feed screw unit 24, designed for moving the regulating wheel base 22, comprises of a feed screw mechanism 24*a* such as ball screw, etc. connected to the regulating wheel base 22 in a way to screw and move forward and backward, and a servo motor 24*b* for rotating and driving this feed screw mechanism 24*a*. This servo motor 24*b* is placed on the slide base 23, and is connected electrically to the controller 6.

Furthermore, the feed angle (inclination) of the regulating wheel 2, namely the inclination of the main spindle 20 is adjustable. In this system, the feed angle of the regulating wheel 2 is set substantially at 0° C., thereby realizing a construction in which no thrust force in an axial direction acts on the works W, W, . . . .

Figure 6:
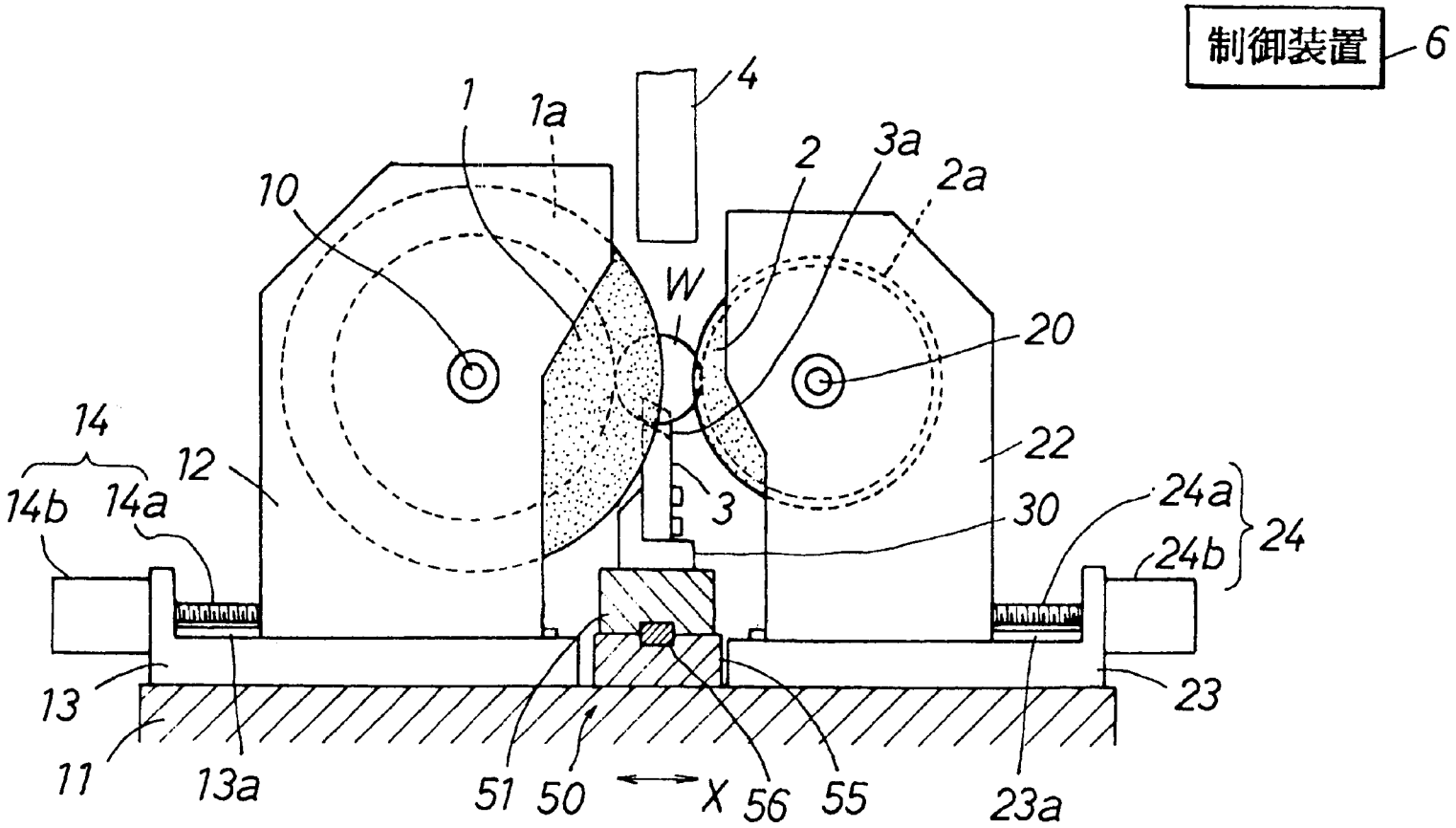
FIG. 6 is a front elevation showing the centerless grinding machine, and indicates a state in which works are submitted to grinding.

The blade 3 is intended to support the lower part of the outside cylindrical surface of the works W, W, . . . . The blade 3 is, as shown in FIG. 6, fixed on a work rest 30 provided on the equipment bed 11. This work rest 30 is switched to move to and from between the grinding position A and the standby position B for grinding, by a position switcher 50. Thus the work rest 30 is constructed, as described later, in a way to be disposed in a state working selectively with the dresser 5, i.e. at the grinding position A.

Figure 8:
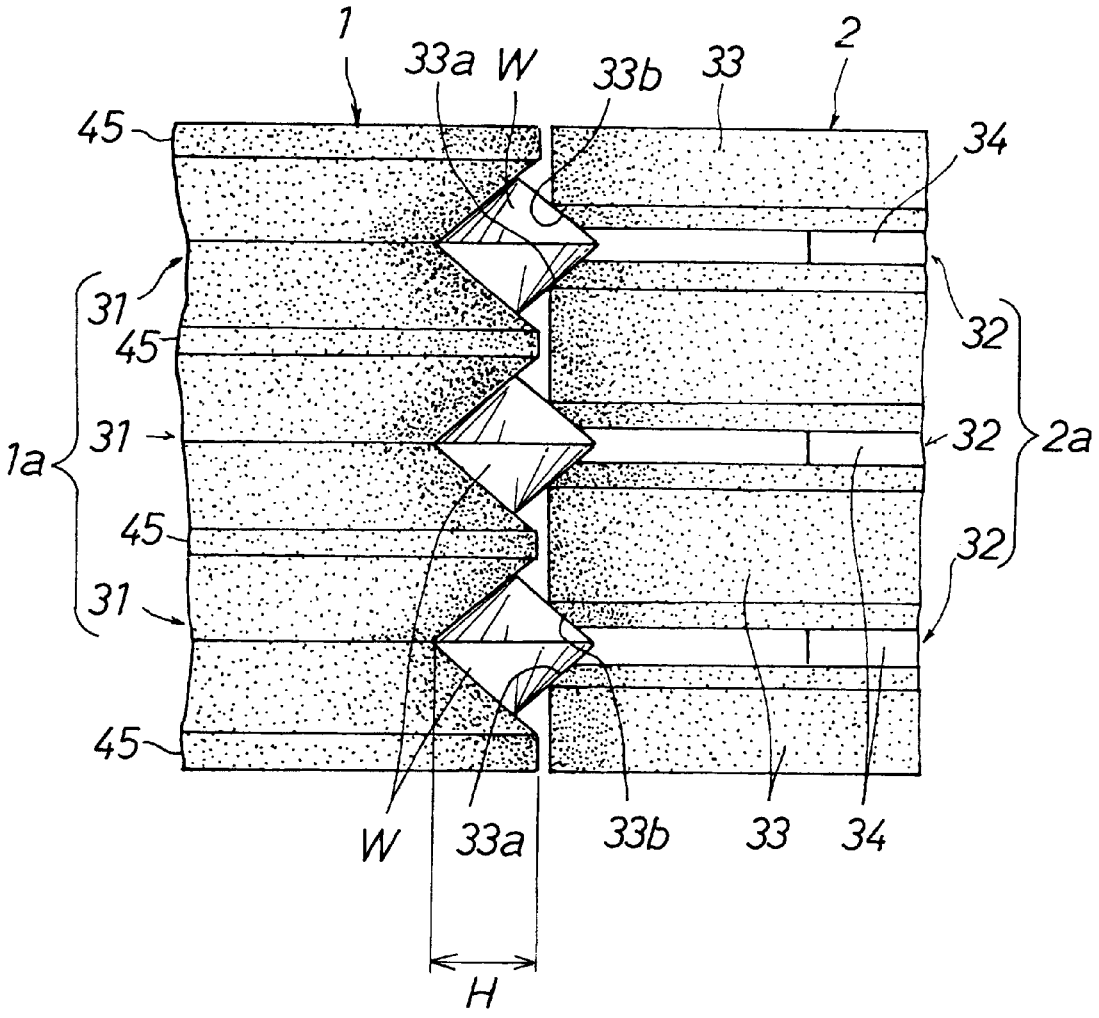
FIG. 8 is an expanded plan view also showing the main part of the centerless grinding machine, and indicates a state in which three double conical rollers are submitted to grinding.
Figure 9:
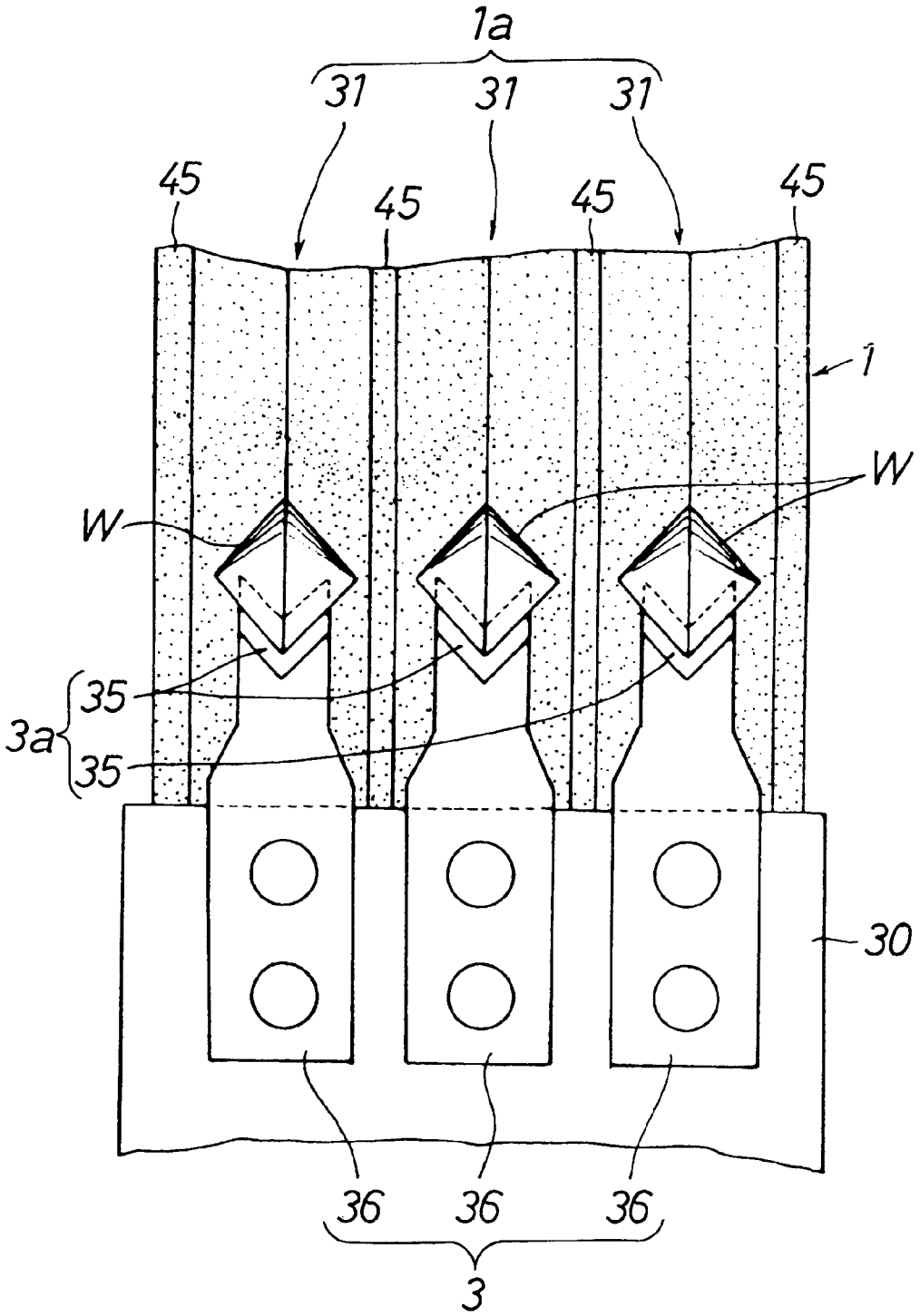
FIG. 9 is an expanded side view also showing the main part of the centerless grinding machine, and indicates a state in which three double conical rollers are submitted to grinding.

The grinding face 1*a* of the grinding wheel 1, the rotary supporting face 2*a* of the regulating wheel 2 and the supporting face 3*a* of the blade 3 have, as shown in FIG. 8 and FIG. 9, with profiles adapted to the double conical faces Wa, Wb, Wa, Wb, Wa, Wb of the three works W, W, W aligned in the direction of shaft line.

To be specific, the grinding face 1*a* is comprised as shown in FIG. 8, of three grinding faces 31, 31, 31 arranged at regular intervals. The respective grinding faces 31 have a V-shaped profile (sectional profile) corresponding to the finished dimension of the double conical faces Wa, Wb of the work W.

The size of this V-shaped grinding face is set in such a way that the grinding may be made to the entire part of said double conical faces Wa, Wb. In other words, the V-shaped groove constituting the grinding face 31 has side wall faces forming a crossed axes angle θ of 90°, in the same way as said double conical faces Wa, Wb of the work W, and its dimension of depth H is set larger than the maximum finished radius of the work W i.e. the radius of the crossing position of the double conical faces Wa, Wb.

Moreover, the rotary supporting face 2*a* of the regulating wheel 2 is comprises three rotary supporting portions 32, 32, 32 disposed in a way to face the grinding faces 31, 31, 31 of said grinding wheel 1 respectively, and each rotary supporting portion 32 has a profile of rotatably supporting a part of the double conical faces Wa, Wb of the work W.

Specifically, the regulating wheel 2 is realized, as shown in FIG. 8, by integrating four pieces of regulating disc 33, 33, . . . in laminated state through spacer disc 34 respectively, and said rotary supporting portion 32 is formed by the end faces 33*a*, 33*b* of adjoining regulating discs 33, 33. Those two end faces 33*a*, 33*b* are constructed in a way to form a part of the circular groove having the same profile as the grinding face 31 of the opposing grinding wheel 1.

The external dimensions of the spacer disc 34 between the two end faces 33*a*, 33*b* is set in such a way that the outer circumferential face of the disc 34 does not get in contact with the work W supported by said two end faces 33*a*, 33*b*. This construction makes it possible for the two end faces 33*a*, 33*b* to rotatably support the double conical faces Wa, Wb of the work W stably at all times, even if the double conical faces Wa, Wb of the work W are deformed with the progress of the grinding.

The supporting face 3*a* of the blade 3 comprises three supporting faces 35, 35, 35 disposed face to face with the grinding faces 31, 31, 31 of the grinding wheel 1 and the rotary supporting parts 32, 32, 32 of the regulating wheel 2 respectively, and each supporting face 35, having a profile adapted to a part of the double conical faces Wa, Wb of the work W, supports the double conical faces Wa, Wb of the work W in such a way that their center axial line is parallel to the axial line of the rotary spindle 10 of the grinding wheel 1.

The blade 3 comprises, as shown in FIG. 9, of three blade members 36, 36, 36 mounted in upright position on the work rest 30, and constitutes said supporting face 35 the top end face of which has a profile adapted to the double conical faces Wa, Wb of the work W.

That is, this supporting face 35 has a V-shaped profile corresponding to the finished dimension of the double conical faces Wa, Wb of the work W namely, along the ridgeline of the double conical faces Wa, Wb of the work W, and is formed as a V-shaped groove supporting the lower part of the double conical faces Wa, Wb. This makes it possible for the supporting face 35 to rotatably support the double conical faces Wa, Wb of the work W stably at all times in such a way that the center axial line of rotation of the work W is parallel to the axial line of the rotary spindle 10 of the grinding wheel 1, even if the double conical faces Wa, Wb of the work W are deformed with the progress of the grinder.

The loader unit 4, intended for carrying in & out three works W, W, W at a time or continuously to the rotary supporting face 2*a* of the regulating wheel 2 and the supporting face 3*a* of the blade 3 at said grinding position A, is disposed at the upper part of the grinding position A. Although no specific construction of this loader unit is illustrated, the chuck unit for chucking the work W is made movable, by a moving unit, between the work feed unit outside the drawing and said grinding position A, while a chucking structure as well-known such as air chuck, etc. is adopted for said chuck unit. The drive source for the chuck unit and moving unit is composed of electric drive source, and is electrically connected to the controller 6.

Figure 7:
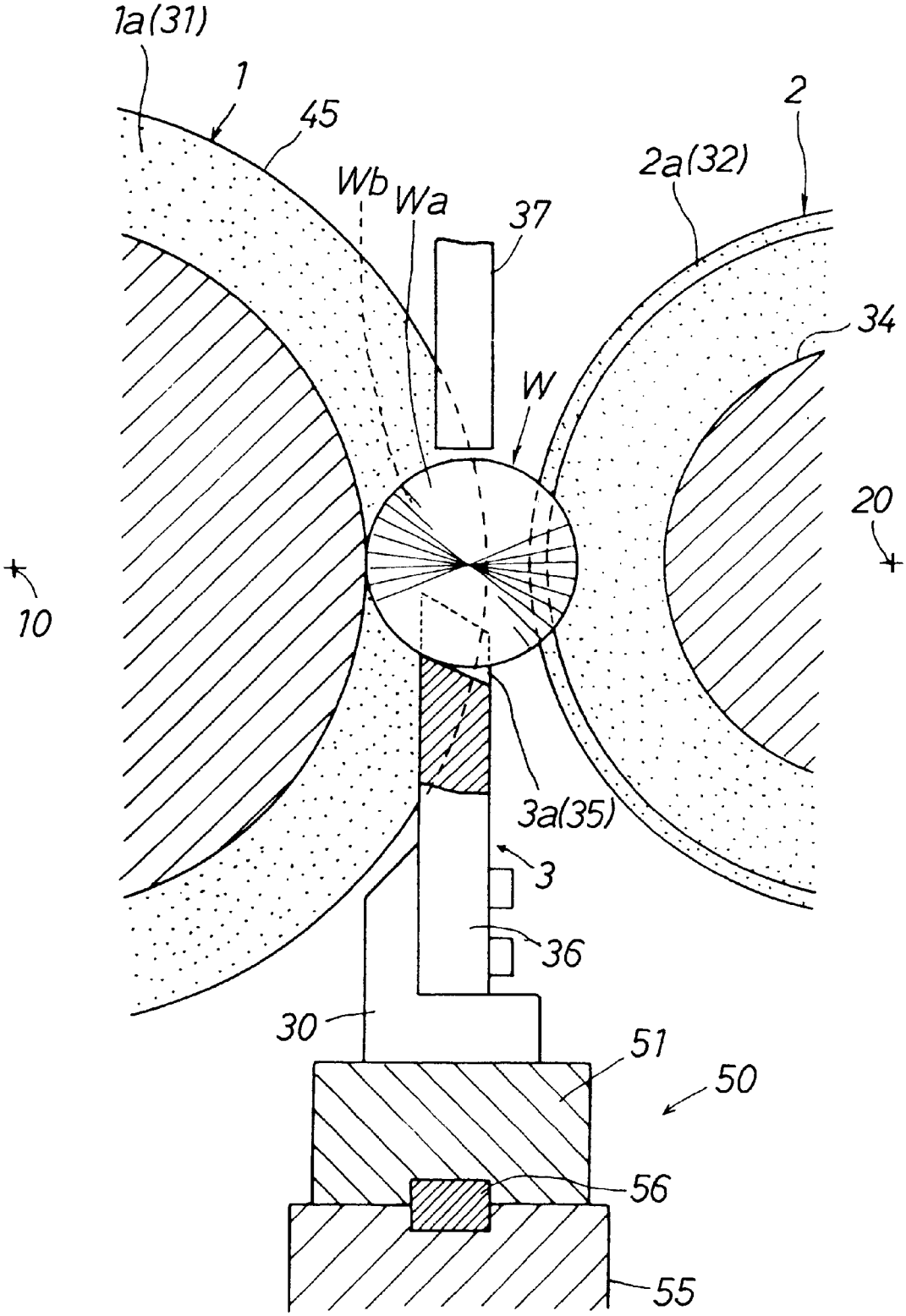
FIG. 7 is an expanded front elevation showing the main part of the centerless grinder, and indicates a state in which double conical rollers are submitted to grinding.

Furthermore, said loader unit 4 is provided with an upper blade 37 as shown in FIG. 7. This upper blade 37 supports, from above, the top part of the double conical surfaces Wa, Wb, . . . of the three works W, W, W rotatably supported at said grinding position A. Although the specific construction of the supporting face of this upper blade 37 is not illustrated, it can be the same as the construction of said supporting face 3*a* of the blade 3, but a flat face for simply holding or keeping the top part of the double conical surfaces Wa, Wb, . . . of the works W, W, W may also be adopted. In short, the supporting face of this upper blade 37 is realized in a structure capable of effectively preventing floating, etc. of the work W under grinding.

The dressing device 5, single dressing structure for performing dressing to both of the grinding face 1*a* of the grinding wheel 1 and the rotary supporting face of the regulating wheel 2, is realized, by having a rotary dresser 40 and a drive motor 41 as main components.

Figure 3:
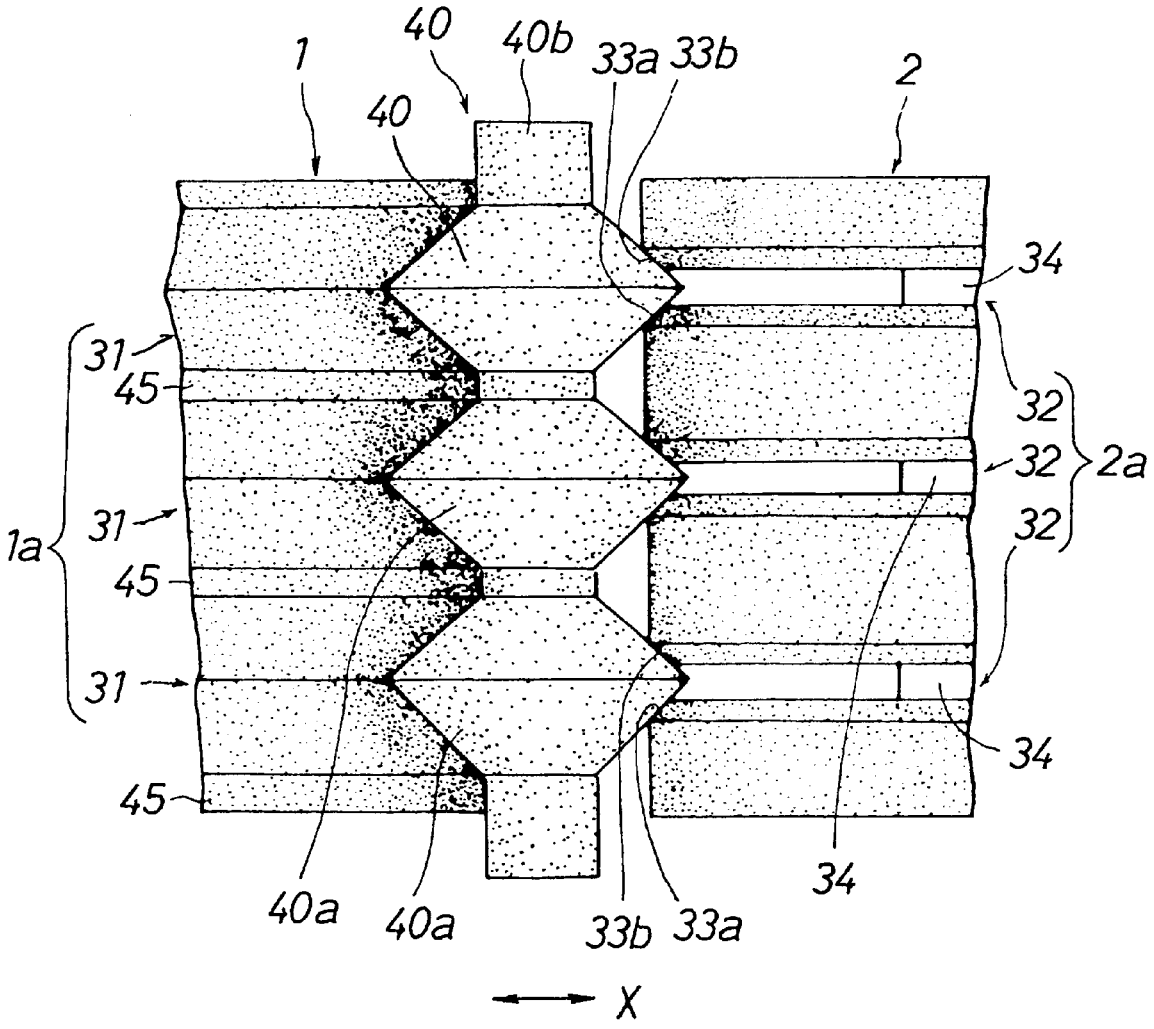
FIG. 3 is an expanded plan view also showing the main part of the dressing device.

The rotary dresser 40 has a profile adapted to the aforementioned grinding face 1*a* and rotary supporting face 2*a*, i.e. a sectional outline shape closely engaging with those grinding face 1*a* and rotary supporting face 2*a*, seen in plan as shown in FIG. 3.

To be concrete, the rotary dresser 40 is a diamond roll and has a shape realized by integrally forming three dressing parts 40*a*, 40*a*, 40*a* and the spindle part 40*b* in the so-called abacus bead shape.

This dressing part 40*a* has a dressing face which substantially coincides with the grinding face 31 of said grinding face 1*a*. In other words, the dressing part 40*a* has a V-shaped profile (sectional outline shape) corresponding to the finished shape and dimensions of the double conical faces Wa, Wb of the work W, its dressing face i.e. outside cylindrical face on both sides has a shape similar to that of the work W, forming a crossed axes angle θ of 90° in the same way as the double conical faces Wa, Wb of the work W.

Moreover, said spindle part 40*b* has such outside dimensions that, in a state where the dressing parts 40*a*, 40*a*, 40*a* substantially coincide with the grinding faces 31, 31, 31 of the grinding wheel 1, its outside cylindrical surface substantially coincides with the cylindrical surfaces 45, 45, . . . adjacent to those grinding faces.

Figure 4:
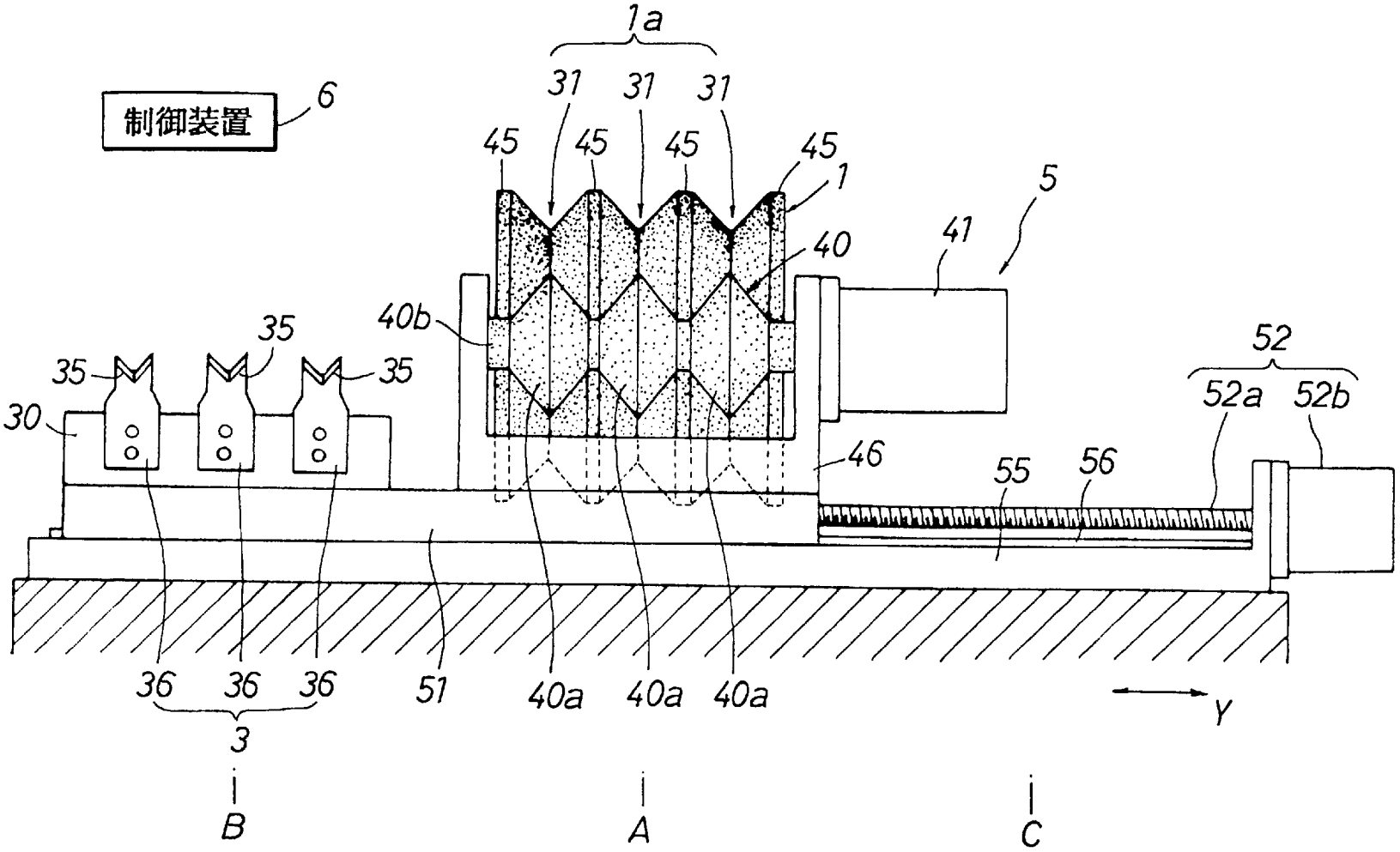
FIG. 4 is a side view showing the entire main part of the centerless grinding machine, and indicates a state in which the dressing device is at the grinding position.
Figure 5:
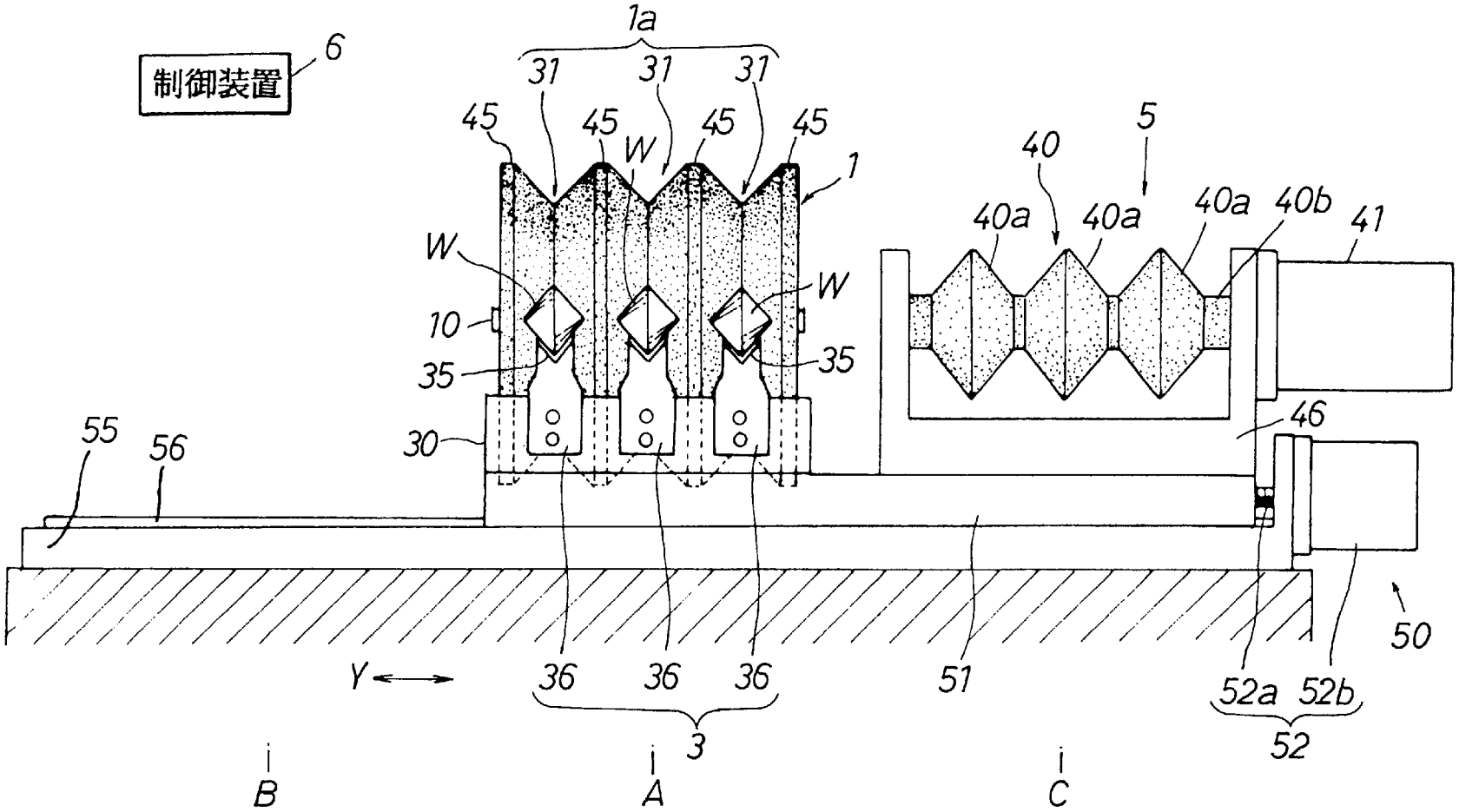
FIG. 5 is a side view also showing the entire main part of the centerless grinding machine, and indicates a state in which a blade is at the grinding position.

The rotary dresser 40, as shown in FIG. 4 and FIG. 5, has its spindle part 40*b* rotatably supported in horizontal state at a dresser base 46, and is connected to said drive motor 41. The drive motor 41, disposed on said dresser base 46, has its rotary spindle connected coaxially with the supporting part 40*b* of said rotary dresser 40, and electrically connected to the controller 6.

The rotary dresser 40 is constructed in a way to perform dressing simultaneously as indicated in FIG. 7 or individually to both the grinding face 1*a* of the grinding wheel 1 and the rotary supporting face 2*a* of the regulating wheel 2 by rotary drive of said servo motor 41.

Furthermore, the dressing device 5 is constructed in a way to be provided fixedly in the radial feed direction X but placed in a working state i.e. disposed in said grinding position A selectively with the blade 3, by said position switcher 50.

The position switcher 50 comprises a slide base 51 and a feed screw unit 52 as main parts. The slide base 51 is movable on the position switcher base 55 provided on the equipment bed 11, between said grinding wheel 1 and regulating wheel 2. On this position switcher base 55 is provided a slide rail 56 in the horizontal direction orthogonal to the radial feed direction X, i.e. in direction Y about parallel to the axial lines of said grinding wheel 1 and regulating wheel 2, so that the slide base 51 may move forward and backward on it.

The slide base 51 is connected to the feed screw unit 52, on which the work rest 30 supporting the blade 3 and the dresser base 46 of the dressing device 5 are disposed and supported at prescribed intervals. In this case, it is so set that the axial line of the work W supported on the blade 3 and the axial line of the rotary dresser 40 of said dressing device 5 are positioned about on one same horizontal plane. Moreover, this axial line of the work W and the axial line of the rotary dresser 40 are set at the same height as the height of the axial lines of the grinding wheel 1 and the regulating wheel 2.

The feed screw unit 52, designed for moving the slide base 51, comprises a feed screw mechanism 52*a* such as ball screw, etc. connected to this slide base 51 in a way to screw and move forward and backward, and a servo motor 52*b* for rotationally driving this feed screw mechanism 52*a*. This servo motor 52*b* is disposed on the position switcher base 55, and electrically connected to the controller 6.

Driven by the feed screw unit 52, said slide base 51 moves forward and backward in the direction Y in the prescribed range, and said blade 3 is switched between the grinding position A and the standby position B for grinding while said rotary dresser 40 is switched between the standby position C for dressing and the grinding position A, thereby disposing the blade 3 and the rotary dresser 40 selectively in the working state (grinding position A) for selective use.

The controller 6, designed for automatically controlling the respective drive sources (servo motor 14*b*, 24*b*, 41, 52*b*, etc.) of said grinding wheel 1, regulating wheel 2, loader 4, dressing device 5 and position switcher 50 interlocking with each other, is, a CNC system constituted by micro computer composed of CPU, ROM, RAM and I/O port, etc. In this controller 6, control program for executing the grinding processes described hereafter is selectively input and set as required, as numerical control data, in advance or from the keyboard, etc. of a non-illustrated control panel.

Next, explanation will be given hereafter on the grinding and dressing processes of the centerless grinding machine described above.

A. Grinding process:

① In the state where the blade 3 is positioned at the grinding position A, as shown in FIG. 5, by the position switcher 50, three works W, W, W are loaded and placed together at said grinding position A by the loader 4 (see FIG. 6). At this time, the rotary dresser 40 is positioned at the standby position C for dressing.

Moreover, the upper blade 37 of said loader 4 supports with slightly spacing, from above, the top part of the double conical surfaces Wa, Wb, of the three works W, W, W loaded at the grinding position A (see FIG. 7).

② In this state, the grinding wheel 1 is relatively fed radially against the works W, W, W, while the grinding wheel 1 and the regulating wheel 2 are rotatably driven, and grinding is performed to the outside cylindrical surface of the work W (see FIG. 7~FIG. 9).

In this case, the common center axial line of rotation of the works W, W, W is supported parallel to the axial line of said grinding wheel 1, the feed angle of the regulating wheel 2 is 0°, and no thrust force in the axial direction acts on the works W, W, W. Moreover, the radial feed of the grinding wheel 1 at this time is made in such a way that either the regulating wheel 2 is radially fed while the positions of the grinding wheel 1 and the blade 3 are fixed or the grinding wheel 1 is radially fed while the positions of the blade 3 and the regulating wheel 2 are fixed.

③ As the grinding of said works W, W, W is completed, the relative radial feed of the grinding wheel 1 against the works W, W, W is stopped and retreated, while those 3 works W, W, W are unloaded i.e. carried out and removed from the grinding position A by the loader 4, after releasing of the support by the upper blade 37.

④ The program returns to ① above and the processes ①~③ are repeated thereafter.

B. Dressing process:

As the above-described grinding process is repeated, the grinding face 1*a* of the grinding wheel 1 and the rotary supporting face 2*a* of the regulating wheel 2 are either crushed, clogged or worn. Therefore, the following dressing process is executed to those faces at prescribed intervals.

① The rotary dresser 40 of the dressing device 5 is positioned to the grinding position A, as shown in FIG. 4, by the position switcher 50, and the blade 3 is moved on standby to the standby position B for grinding.

② In this state, the rotary dresser 40 is rotated and driven, and the grinding wheel 1 and the regulating wheel 2 are radially fed against the rotary dresser 40 while being rotated and driven, to perform grinding to the grinding face 1*a* of the grinding wheel 1 and the rotary supporting face 2*a* of the regulating wheel 2 (see FIG. 3).

The dressing system in this case is selectively adopted for execution in such a way that either the grinding wheel 1 and the regulating wheel 2 are radially fed at a time for simultaneous dressing of the grinding face 1*a* and the rotary supporting face 2*a*, or the grinding wheel 1 and the regulating wheel 2 are radially fed individually one after another so that the grinding face 1*a* and the rotary supporting face 2*a* are dressed individually and independently of each other, etc.

Thus, in this embodiment, the dressing made at proper intervals respectively to the grinding face 1*a* of the grinding wheel 1 (grinding faces 31, 31, 31) and the rotary supporting face 2*a* of the regulating wheel 2 (rotary supporting parts 32, 32, 32) is performed by a single dressing device 5 provided with a rotary dresser 40 having a profile adapted to said grinding face 1*a* and rotary supporting face 2*a*. Therefore, the dressing and truing of said grinding face 1*a* and rotary supporting face 2*a* is performed accurately and at high precision regardless of the complexity or not of that profile, and any relative displacement in the axial direction of 1 and 2 are not produced in the course of dressing, and the positioning in the axial direction of the grinding wheel 1 and the regulating wheel 2 after the dressing can be made easily and accurately.

Moreover, the system of said dressing is, as described above, selectively adopted for execution in such a way that either the grinding wheel 1 and the regulating wheel 2 are radially fed at a time for simultaneous dressing of the grinding face 1*a* and the rotary supporting face 2*a*, or the grinding wheel 1 and the regulating wheel 2 are radially fed individually one after another so that the grinding face 1*a* and the rotary supporting face 2*a* are dressed individually and independently of each other, etc. Especially in the case where the grinding wheel 1 and the regulating wheel 2 are submitted to dressing at a time as in the former case, clogging of the rotary dresser 40 is effectively prevented, thus enabling execution of efficient dressing.

Namely, from the results of tests and researches made by the inventor, etc., it has been found that, in the case where only the rotary supporting face 2*a* of the regulating wheel 2 is dressed by a rotary dresser 40, the dressing face of the rotary dresser 40 55 is liable to be clogged because the binder for the abrasive grains constituting said rotary supporting face is of comparatively high viscosity and soft. On the other hand, if the grinding face 1*a* of the grinding wheel 1 is also dressed at the same time, it produces a dressing effect to the rotary dresser 40 and a clogging preventive effect with the abrasive grains on the grinding wheel 1 side, etc., thus effectively preventing clogging of the regulating wheel 2 and improving the dressing performance.

From what has been stated above, the grinding wheel 1 and the regulating wheel 2 shall preferably be dressed simultaneously for efficient dressing.

Furthermore, since the dressing device 5 is disposed on the equipment bed 11, the mounting rigidity of the dressing device 5 is sufficiently secured, thus ensuring accurate and high-precision dressing also in this respect.

Still more, in this embodiment, the respective works W, W, W are ground in a constantly stable state of alignment without producing overturn, etc. in spite of their comparatively small length, in said grinding process, because, in combination with said construction of the dressing device 5, the grinding face 1*a* of the grinding wheel 1 (grinding faces 31, 31, 31) and the rotary supporting face 2*a* of the regulating wheel 2 (rotary supporting parts 32, 32, 32) have profiles adapted to the double conical faces Wa, Wb, . . . of the aligned three works W, W, W, said supporting face 3*a* of blade 3 (supporting faces 35, 35, 35) support those double conical faces Wa, Wb, . . . in such a way that their common center axial line becomes parallel to the axial line of the grinding wheel 1, and that no feed angle is provided on the regulating wheel 2.

As a result, the three double conical rollers W, W, W are ground simultaneously and at high processing accuracy, making it possible to mass process a large number of works W, W, . . . , at high processing accuracy, continuously and automatically, to realize sharp reduction of manufacturing costs by mass processing of double conical rollers W which has so far been considered as impossible.

Figure 11A:
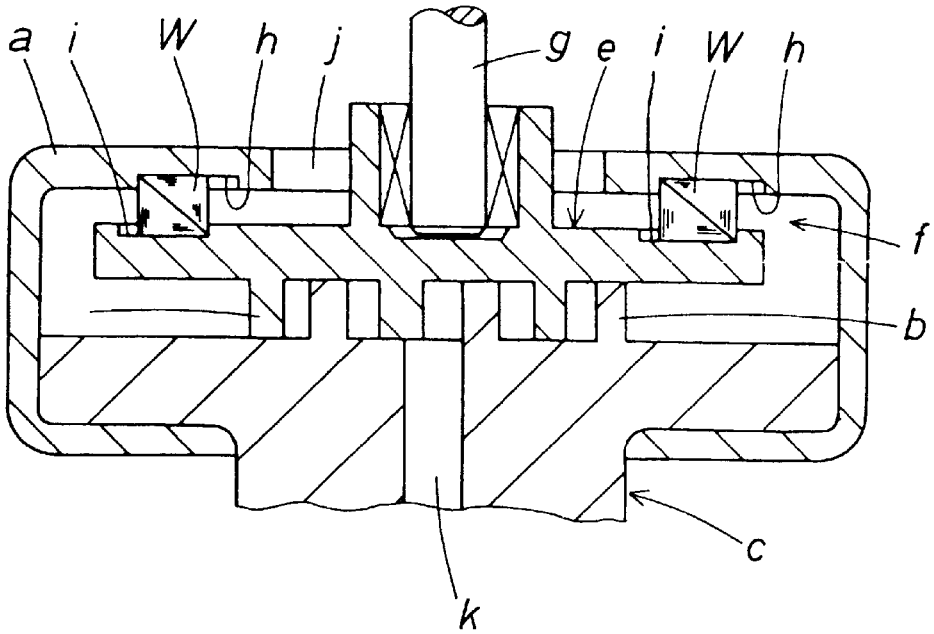
FIG. 11(*a*) is a front sectional view showing a scroll type compressor provided with the double conical rollers as component parts.
Figure 11B:
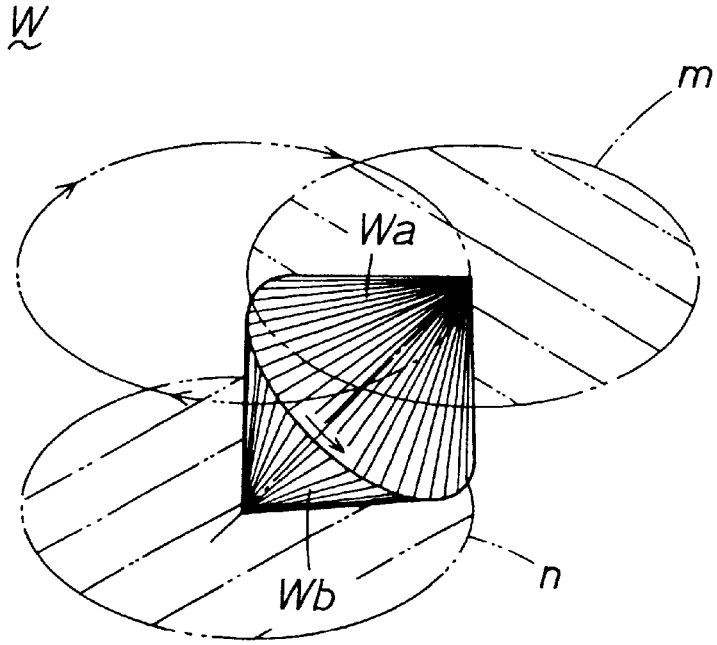

The double conical rollers W manufactured this way are suitably applied as component parts for thrust force supporting structure in a scroll type compressor as indicated in FIG. 11(*a*) for example, and the outer circumferential faces Wa, Wb of the double conical roller W make rolling motion in the state of linear contact with the flat bottom faces (m),(n) of the concavities (h),(i), as shown in FIG. 11(*b*). As a result, it becomes possible to put to practical use a scroll type compressor with much improved durability compared with a conventional scroll type compressor using rolling members which are composed of balls for said supporting structure, and capable of fully demonstrating characteristics of scroll drive (possibility of high-speed operation with little fluctuations of torque or vibrations).

Embodiment 2

Figure 12:
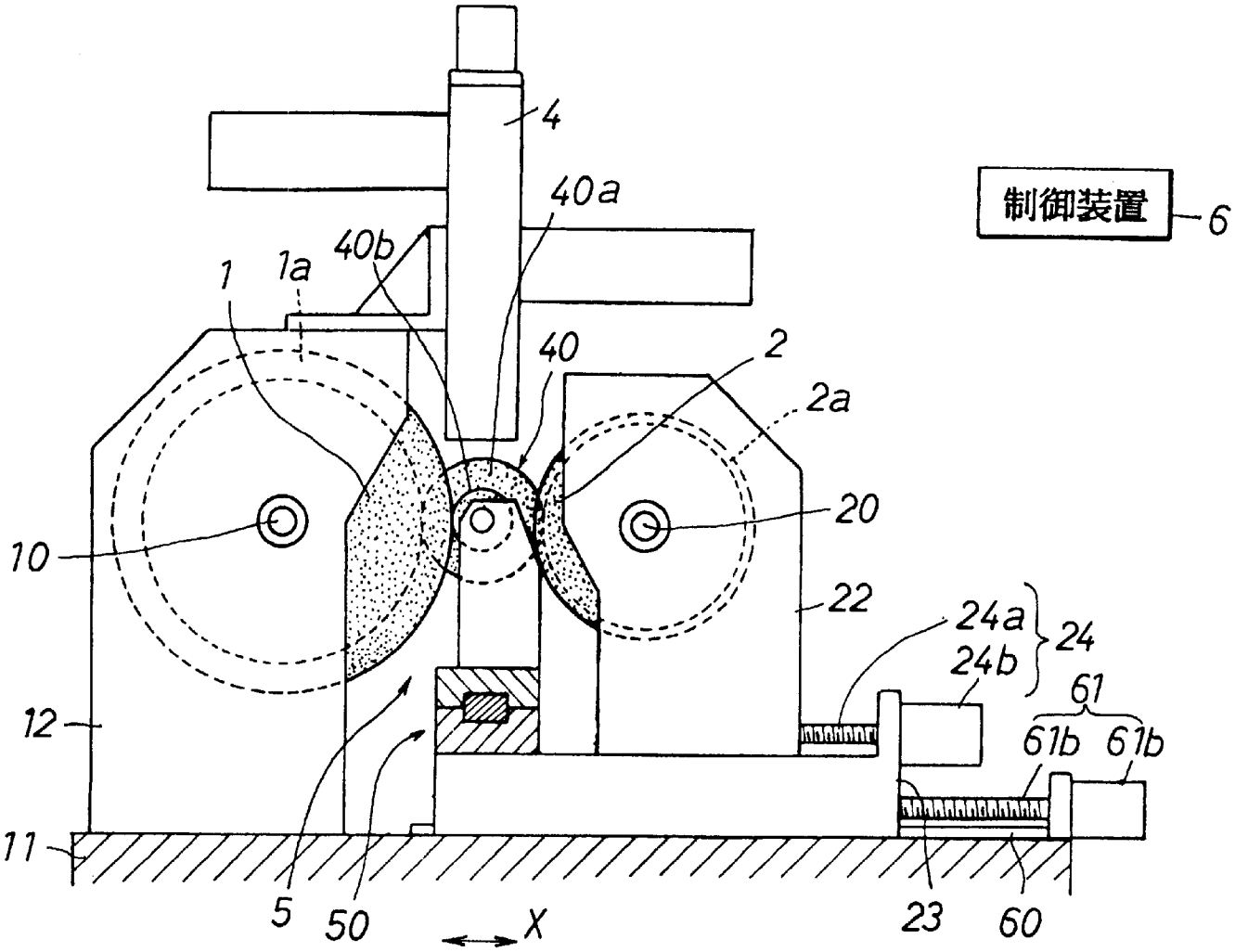
FIG. 12 is a front elevation showing a centerless grinding machine provided with a dresser which is the second embodiment of the present invention, and indicates the state in which both the grinding wheel and the regulating wheel are dressed simultaneously by means of a single rotary dresser.

This embodiment, indicated in FIG. 12, is realized by modifying the relative relation between the dressing device 5 and the grinding wheel 1 and the regulating wheel 2.

Namely, in the centerless grinding machine, the grinding wheel 1 is fixedly provided in the radial feed direction X while the regulating wheel 2 is constructed in a way to be movable in the radial feed direction X and, in relation to it, the rotary dresser 40 of the dressing device 5 is provided in a way to be movable in the radial feed direction X.

The grinding wheel base 12, on which to mount and support the grinding wheel 1, is fixed on the equipment bed 11. On the other hand, the regulating wheel base 22, on which to mount and support the regulating wheel 2, is provided in a way to be movable forward and backward in the radial feed direction X on the slide base 23, by means of the feed screw unit 24. This slide base 23 is further provided in a way to be movable forward and backward in the radial feed direction X along a slide rail 60 provided on the equipment bed 11, and connected to a feed screw unit 61. This feed screw unit 61, designed to move the slide base 23, comprises a feed screw mechanism 61*a* such as ball screw, etc. connected to the slide base 23 in a way to be screwed and move movable forward and backward and a servo motor 61*b* for rotating and driving this feed screw mechanism 61*a*. This servo motor 61*b* is placed on the equipment bed 11, and is connected electrically to the controller 6.

Moreover, on said slide base 23 is mounted a positioner 50, to thereby switch and move the blade 3 and the rotary dresser 40 on this slide base 23.

Thus, in the centerless grinding machine of this embodiment, though not illustrated, grinding is performed to the outside cylindrical surface of the works W, W, W as the grinding wheel 1 is radially fed relatively against the works W, W, W while the grinding wheel 1 and the regulating wheel 2 are rotatably driven. The radial feed at this time is made in the state where the relative position of the grinding wheel 1 and the blade 3 is constant and that the regulating wheel 2 is either radially fed or the blade 3 and the regulating wheel 2 are radially fed with maintaining their relative relation (in position) constant.

Furthermore, in the dressing process performed at prescribed intervals, while the rotary dresser 40 is rotatably driven, the grinding wheel 1 and the regulating wheel 2 radially fed relatively against the rotary dresser 40 with the grinding wheel 1 and the regulating wheel 2 rotatably driven, to perform dressing to the grinding face 1*a* of the grinding wheel 1 and the rotary supporting face 2*a* of the regulating wheel 2. The radial feed at this time is made, in the dressing to the grinding wheel 1, as the dressing device 5 moves by means of the feed screw unit 61 and the rotary dresser 40 is radially fed. On the other hand, in the dressing to the regulating wheel 2, the regulating wheel base 22 moves by means of the feed screw unit 24 and the regulating wheel 2 is radially fed.

The dressing system in this case is, in the same way as in Embodiment 1, selectively adopted for execution in such a way that either the grinding wheel 1 and the regulating wheel 2 are dressed at a time or the grinding wheel 1 and the regulating wheel 2 are dressed individually and independently of each other, etc.

The other constructions and actions are the same as those in the Embodiment 1.

Embodiment 3

Figure 13:
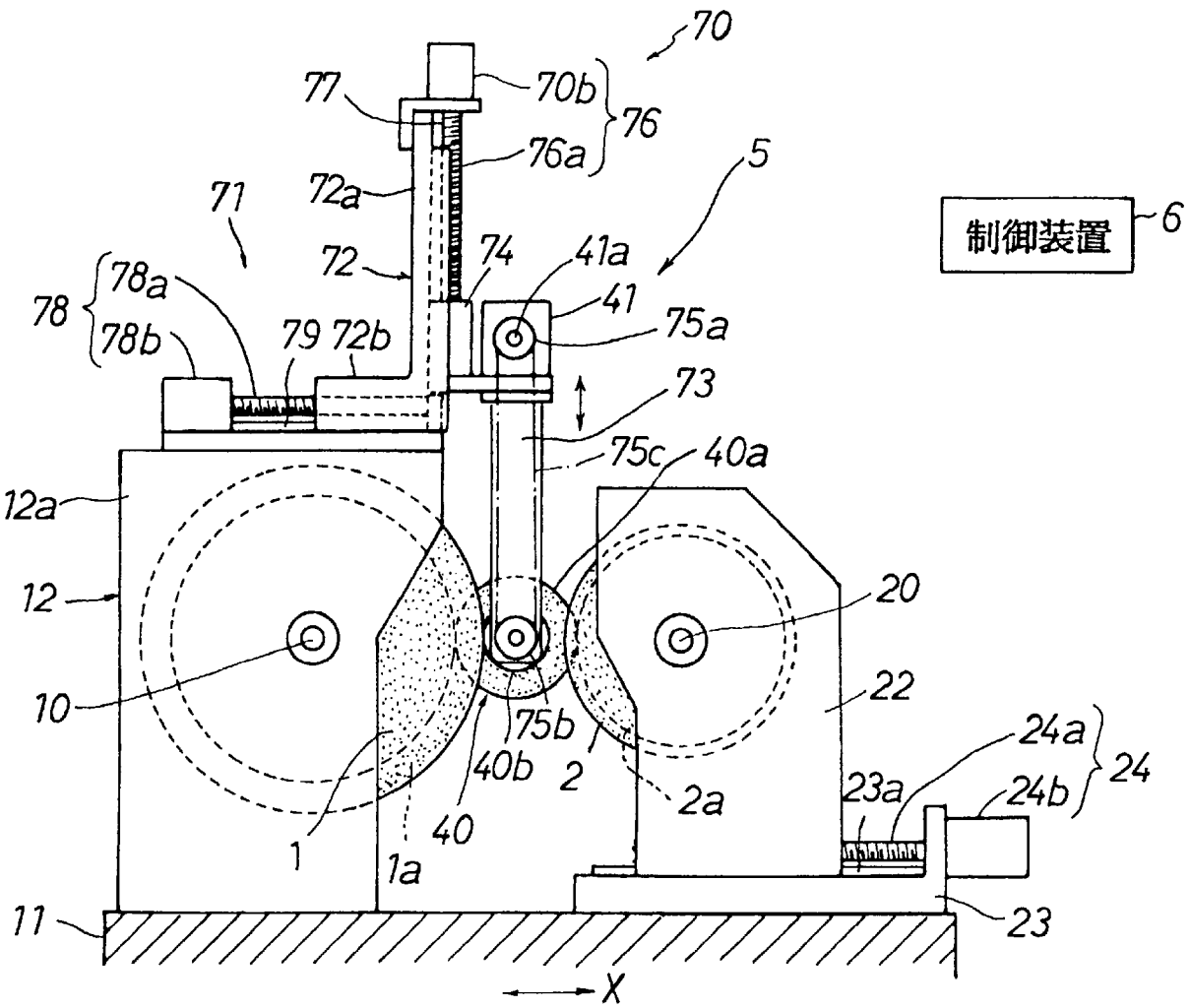
FIG. 13 is a front elevation showing a centerless grinding machine provided with a dresser which is the third embodiment of the present invention, and indicates the state in which both the grinding wheel and the regulating wheel are dressed simultaneously by means of a single rotary dresser.

This embodiment, indicated in FIG. 13, is realized by modifying the relative relation in structure between the dressing device 5 and the grinding wheel 1 and the regulating wheel 2, as well as the relative relation in structure between the dressing device 5 and the blade 3.

Namely, the grinding wheel 1 and the blade 3 (not illustrated in FIG. 13) are fixedly provided in the radial feed direction X while the regulating wheel 2 is constructed in a way to be movable in the radial feed direction X. In relation to it, the dresser 5 is provided above the grinding wheel 1 while its rotary dresser 40 is provided in a way to be movable up and down and also movable in the radial feed direction X.

The grinding wheel base 12, on which to mount and support the grinding wheel 1, is fixed on the equipment bed 11, in the same way as in the Embodiment 2. On the other hand, the regulating wheel base 22, on which to mount and support the regulating wheel 2, is provided in a way to be movable forward and backward in the radial feed direction X along the slide rail 23*a* on the slide base 23, in the same way as in the Embodiment 1, and connected to the feed screw unit 24. Though not illustrated, the blade 3 is fixedly provided on the equipment bed 11 through the work rest 30.

Moreover, the dressing device 5 is disposed on the grinding wheel cover 12*a* of said grinding wheel base 12. The dressing device 5, which is the only dressing structure for performing dressing to both the grinding face 1*a* of the grinding wheel 1 and the rotary supporting face 2*a* of the regulating wheel 2 as in Embodiment 1 and 2, is realized, by having rotary dresser 40 and drive motor 41 as well as lifter 70 for moving up and down them and radial feed device 71 for moving them in the radial feed direction X.

The rotary dresser 40 has its spindle part 40*b* rotatably supported in horizontal state at the lower end of the lifting arm 73 mounted on the dresser body 72. The lifting arm 73 is liftably supported on said dresser body 72 by the lifting slide 74, and at its top end is provided said drive motor 41. The drive shaft 41*a* of this drive motor 41 and the spindle part 40*b* of said rotary dresser 40 are connected to each other for driving through the transmission pulleys 75*a*, 75*b* and the transmission pulley 75*c*.

The lifter 70 comprises said lifting slide 74 and feed screw unit 76 as main components. The lifting slide 74 is provided in a way movable forward and backward (lifting motion) in vertically up-down direction on the vertical rail 77 of the upright portion 72*a* of said dresser body 72 realized in L shape. The lifting slide 74 is provided on it with said rotary dresser 40 and drive motor 41, and is connected to the feed screw unit 76. This feed screw unit 76 comprises feed screw mechanism 76*a* such as ball screw, etc. connected to the lifting slide 74 in a way to screw and move forward and backward, and servo motor 76*b* for rotatably driving this feed screw mechanism 76*a*. This servo motor 76*b* is disposed on the upright portion 72*a* of said dresser body 72, and is electrically connected to the controller 6.

Moreover, the radial feed unit 71 comprises said dresser body 72 and feed screw unit 78 as main components. The dresser body 72 has its horizontal slide base 72*b* provided in a way to be movable forward and backward in the radial feed direction X, along the horizontal rail 79 provided on the top face of said grinding wheel cover 12*a*, and is connected to the feed screw unit 78. This feed screw unit 78 comprises a feed screw mechanism 78*a* such as ball screw, etc. connected to the horizontal slide base 72*b* of the dresser body 72 in a way to screw and move forward and backward, and a servo motor 78*b* for rotatably driving this feed screw mechanism 78*a*. This servo motor 78*b* is disposed on the grinding wheel cover 12*a*, and is electrically connected to the controller 6.

The rotary dresser 40 is driven by said lifter 70 to move up and down between the grinding wheel 1 and the regulating wheel 2, and is also driven by said radial feed unit 71 to perform dressing to both the grinding face 1*a* of the grinding wheel 1 and the rotary supporting face 2*a* of the regulating wheel 2, simultaneously as shown in FIG. 3, or, though not illustrated, individually. In this case, the height of the shaft center of the rotary dresser 40 is set at the same height as the shaft center of the grinding wheel 1 and the regulating wheel 2, in the same way as in the Embodiment 1.

Moreover, the dressing device 5 and the blade 3 as well as the dressing device 5 and loader 4 (not illustrated in this embodiment) are constructed to be driven and controlled in a way not to interfere with each other and, for that purpose, the work carry-in(loading) and carry-out(unloading) route of the loader 4, for example, is suitably designed to be in horizontal direction and not in vertical direction as in the Embodiment 1 and 2.

Thus, in the centerless grinding machine of this embodiment, though not illustrated, grinding is performed to the outside cylindrical surfaces of the works W,W ,W as the grinding wheel 1 is radially fed relatively against the works W, W, W while the grinding wheel 1 and the regulating wheel 2 are rotatably driven. The radial feed at this time is made in the state where the relative position of the grinding wheel 1 and the blade 3 is constant and that the regulating wheel 2 is radially fed.

Furthermore, in the dressing process performed at prescribed intervals, while the rotary dresser 40 is driven by the lifter 70 to descend down to the prescribed dressing height position (position at which the height of shaft center of the rotary dresser 40 becomes equal to the height of shaft center of the grinding wheel 1 and the regulating wheel 2 in the illustration). The rotary dresser 40 is rotatably driven while descending or after the descent, and the grinding wheel 1 and the regulating wheel 2 are radially fed relatively against the rotary dresser 40, to perform dressing to the grinding face 1*a* of the grinding wheel 1 and the rotary supporting face 2*a* of the regulating wheel 2.

The radial feed at this time is made, in the dressing to the grinding wheel 1, as the dressing device 5 moves by means of the radial feed unit 71 and the rotary dresser 40 is radially fed. On the other hand, in the dressing to the regulating wheel 2, the regulating wheel base 22 moves by means of the feed screw unit 24 and the regulating wheel 2 is radially fed. The amount of radial feed (feed amount for dressing) in this case is about double the radial feed amount of the rotary dresser 40.

The dressing system in this case, and the other constructions and actions are the same as those in the Embodiment 1.

The Embodiments given above simply indicate preferred embodiments of the present invention, and the present invention is not limited to such embodiments but may be submitted to various design modifications in the range thereof. As examples, the following modifications are conceivable:

(1) The basic construction of centerless grinding machine such as grinding wheel 1, regulating wheel 2, blade 3 and loader unit 4, etc. is not limited to the illustrated structures, but other known structures having same or similar functions may also be adopted.

(2) In the illustrated embodiments, having a structure for simultaneously grinding a plural number of short works W, W, . . . , the grinding face 1*a* of the grinding wheel 1, the rotary supporting face 2*a* of the regulating wheel 2 and the supporting face 3*a* of the blade 3 are all provided with a complicated profile adapted to the double conical surfaces Wa, Wb, Wa, Wb, . . . of those aligned plural number of works W, W, . . . and, in corresponding to it, the rotary dresser 40 of the dressing device 5 also has a complicated profile adapted to said grinding face la and rotary supporting face 2*a*. However, the dressing device 5 according to the present invention is not limited to such structure but may also be applied widely to other general centerless grinding machines of conventional knowledge.

(3) In addition to the double conical rollers as in the embodiments described above, the object work W may also be rotating members of short dimensions having other non cylindrical outer circumferential surfaces, i.e. outer circumferential surfaces of rotating members other than right cylindrical surface such as outer circumferential surface in which the diameter continuously varies linearly in the axial direction (tapered face), outer circumferential surface in which the diameter continuously varies curvilinearly in the axial direction, stepped outer circumferential surface in which the diameter varies discontinuously or outer circumferential surface in which those factors are combined in various ways, etc. For example, the works W as shown in FIG. 14 and FIG. 15 can also be ground.

Figure 14:
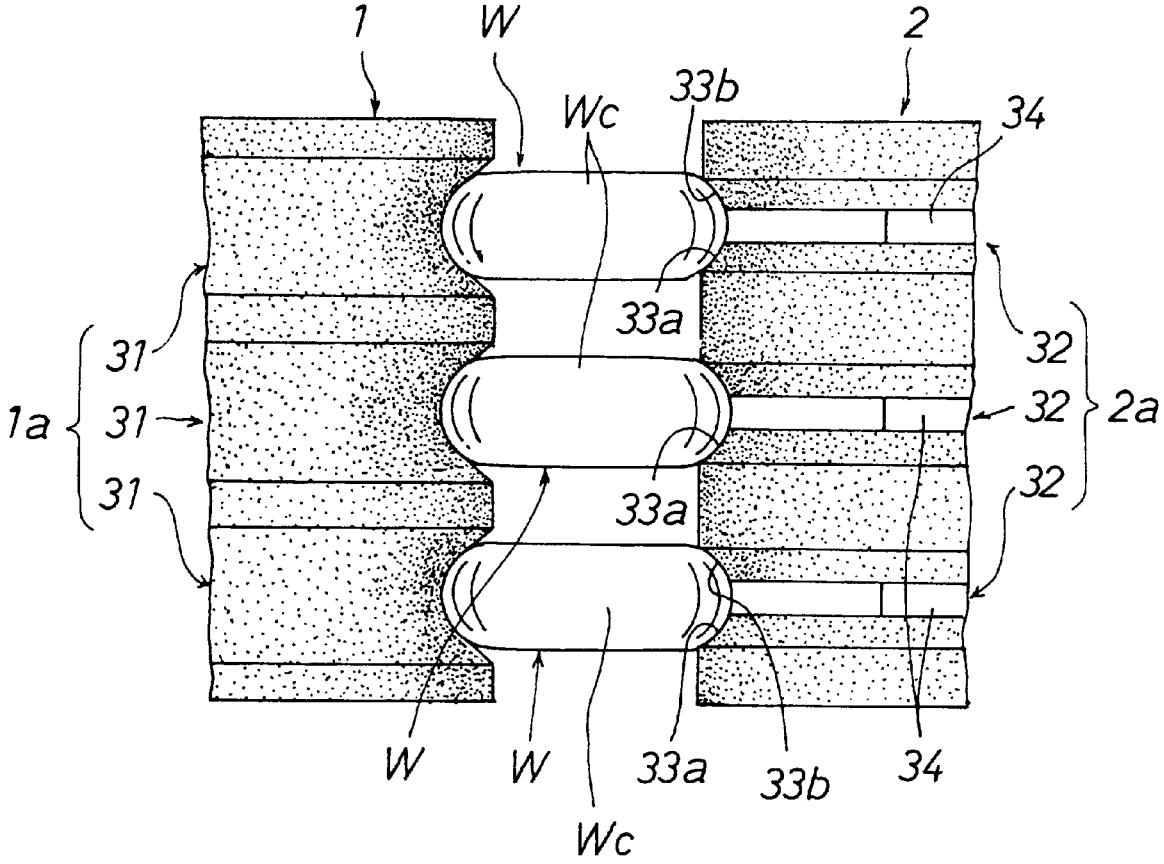
FIG. 14 is an expanded plan view corresponding to FIG. 8, showing a modified example of a case in which a rotor of short dimensions having other non-cylindrical outer circumferential surface is submitted to grinding by the centerless grinding machine.
Figure 15:
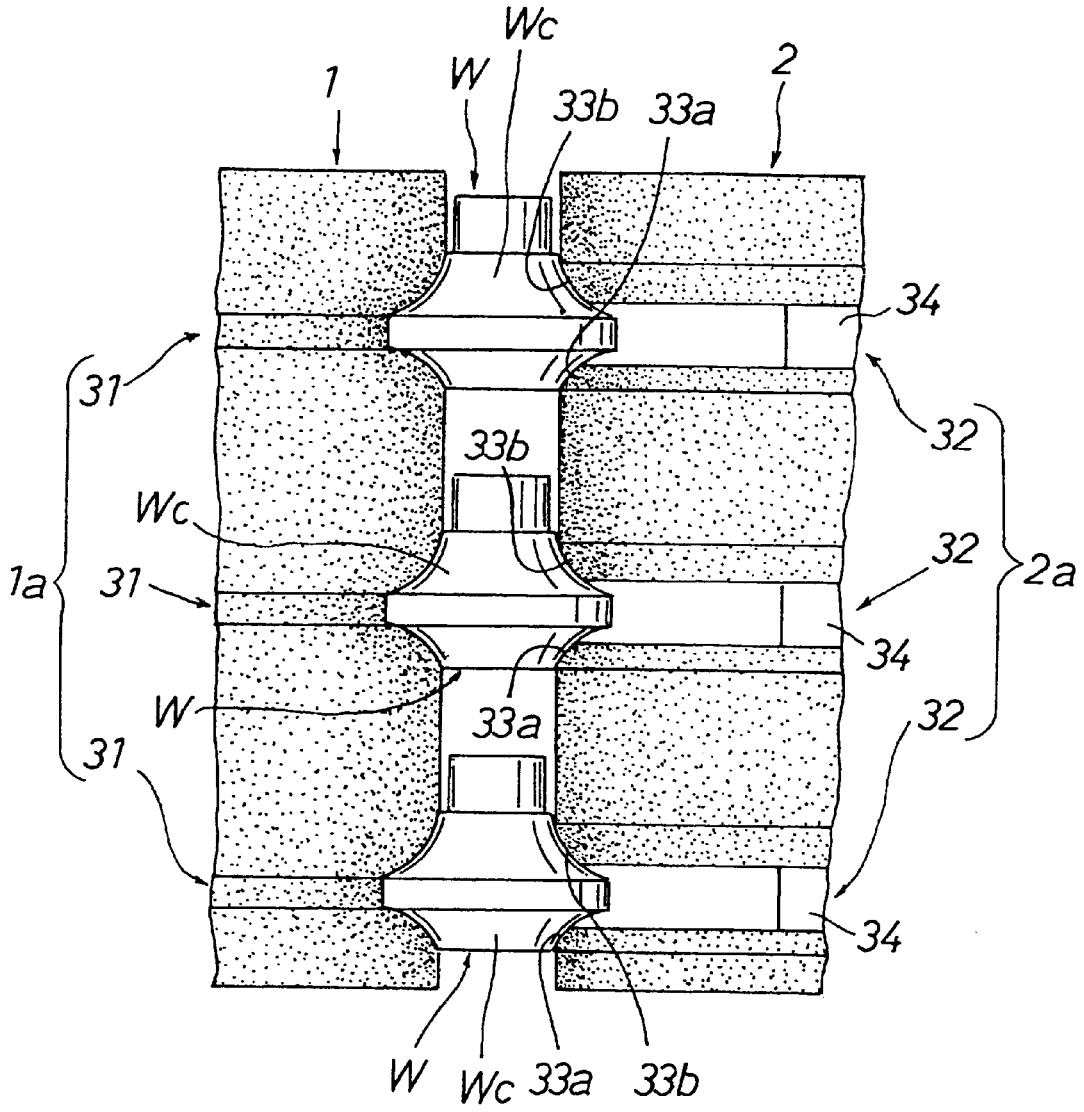
FIG. 15 is an expanded plan view corresponding to FIG. 8, also showing a modified example of a case in which a rotor of short dimensions having still another non-cylindrical outer circumferential surface is submitted to grinding by the centerless grinding machine.

Namely, in FIG. 14, the outer circumferential surface Wc of the work W has an outline in the shape of convex arc while, in FIG. 15, the outer circumferential surface Wc of the work W has an outline formed by a combination of two convex arcs and straight lines. In corresponding to such outlines, in either case, the grinding face 1*a* of the grinding wheel 1, the rotary supporting face 2*a* of the regulating wheel 2 and the supporting face 3*a* (not illustrated) of the blade 3 are all provided with a profile adapted to the outer circumferential surfaces Wc, Wc Wc of three works W, W, W aligned in the direction of the axial line.

(4) The structure in the illustrated embodiments is realized in a way to collectively grind three works W, W, W, the number of works W to be processed can be increased or decreased as required according to the purpose as a matter of course.

As described in detail above, the present invention, which is provided with a single dressing structure for performing dressing to the grinding face of the grinding wheel and the rotary supporting face of the regulating wheel, presents various effects as described below, thus enabling effective dressing, and can provide dressing technology capable of performing relative positioning in the axial direction of the grinding wheel and the regulating wheel after dressing, easily and accurately.

(1) Since one dressing unit is enough, the equipment cost is reduced compared with conventional system, and the grinding machine itself can be realized in a compact and simple construction because the installation space of the dresser can be provided between the grinding wheel and the regulating wheel.

(2) Since said dressing structure is, preferably, provided with a rotary dresser having a profile fit for the grinding face of grinding wheel and the rotary supporting face of regulating wheel, it becomes possible to perform dressing and truing of said grinding face and rotary supporting face accurately regardless of the complexity or not of their profile without producing any relative displacement in axial direction between the grinding wheel and the regulating wheel. Therefore, even in a centerless grinding machine of radial feed system for which relative positioning in the axial direction of the grinding face of grinding wheel and the regulating wheel is extremely important, the positioning in the axial direction of the two after dressing can be performed easily and accurately, thus enabling change of setup, etc. in shorter time.

(3) Accurate relative positioning in axial direction of grinding wheel and regulating wheel not only shortens the setup time for carry-in(loading) and carry-out(unloading) of work and change of setup for operation but also enables mass production by automation of setup for operation.

(4) If said dressing is performed to said grinding face of grinding wheel and rotary supporting face of regulating wheel at a time, clogging of the rotary dresser is effectively prevented, thus enabling efficient dressing.

Namely, in the case where dressing by rotary dresser is made only to the rotary supporting face of regulating wheel, the dressing face of the rotary dresser is liable to be clogged, because the binder for the abrasive grains constituting said rotary supporting face is of comparatively high viscosity and soft. On the other hand, simultaneous dressing of the grinding face of grinding wheel and the rotary supporting face of regulating wheel produces a dressing effect to the rotary dresser and a clogging preventive effect with the abrasive grains on the grinding wheel side, etc., thus effectively preventing clogging of the regulating wheel and improving the dressing performance.

Moreover, a centerless grinding machine provided with a grinding wheel having grinding face of a profile suitable for double conical face of conical rollers, a regulating wheel having rotary supporting face of a profile suitable for double conical face of conical rollers, and a blade having supporting face for supporting double conical face of conical rollers in such a way that the axial line of said grinding wheel becomes parallel to the axial line of the center axial line of rotation of the conical rollers, and adopting said dressing technology, can provide the following effects in addition to the effects described above:

(a) In spite of their short dimensions (dimension of length in axial direction is comparatively smaller than outside diameter), the conical rollers are ground constantly in a stable aligned state even in the case of simultaneous grinding of a plural number of pieces, without producing overturn, etc. As a result, it becomes possible to submit a large number of double conical rollers to mass processing continuously and automatically, sharply reducing the manufacturing cost by mass processing.

This makes it possible to utilize centerless grinding technology also for double conical rollers, which were typical works requiring high finishing accuracy (surface roughness, roundness, etc.) and mass producibility, thus realizing grinding of high working accuracy and high working efficiency and enabling continuous and automatic mass processing of a large number of double conical rollers. As a result, sharp reduction of manufacturing cost by mass processing of double conical rollers, which has been considered as impossible in the past, is realized.

Therefore, it also becomes possible to put to practical use a thrust force supporting structure having double conical rollers as component parts and, eventually, a scroll type compressor with much improved durability compared with conventional type, provided with such supporting structure.

(b) Since dressing to said grinding face of grinding wheel and rotary supporting face of regulating wheel is performed by a single dressing system provided with a rotary dresser having a profile fit for said grinding face of grinding wheel and the rotary supporting face of regulating wheel, this makes it possible to perform dressing and truing of said grinding face and rotary supporting face accurately in spite of the complexity of their profiles. As a result, the positioning in the axial direction of the grinding wheel and the rotary supporting face can be made accurately without producing any relative displacement in the axial direction between the two, the time for loading and unloading of work and change of setup for operation is shortened, mass production by automation of setup work becomes possible, and the equipment cost can be controlled low.

The specific embodiments presented in the paragraph of detailed description of the invention above are essentially intended for clarification of the technical contents of the present invention and, therefore, shall not be interpreted in narrow sense as being limited to the examples described above only, but shall be interpreted in broader sense as being available for practicing with a variety of modifications in the spirit of the present invention and within the range described in the claims.

What is claimed is:

1. A dressing method for a centerless grinding machine comprising the steps of:

providing a grinding wheel;

providing a regulating wheel;

providing a dressing device including a single dressing wheel for performing dressing to a grinding face of the grinding wheel and a rotary supporting face of the regulating wheel; and simultaneously performing dressing to the grinding face of the grinding wheel and the rotary supporting face of the regulating wheel, by the single dressing wheel, wherein the single dressing wheel comprises a rotary dresser having a profile fit for the grinding face of the grinding wheel and the rotary supporting face of the regulating wheel.

2. A dressing method for a centerless grinding machine comprising the steps of:

providing a grinding wheel;

providing a regulating wheel;

providing a single dressing wheel for performing dressing to the grinding face of the grinding wheel and the rotary supporting face of the regulating wheel wherein, the single dressing wheel comprises a rotary dresser having a profile fit for the grinding face of the grinding wheel and the rotary supporting face of the regulating wheel; and performing dressing to the grinding face of the grinding wheel and the rotary supporting face of the regulating wheel separately, by the single dressing wheel.

3. A dressing device for a centerless grinding machine comprising:

a grinding wheel;

a regulating wheel; and a single dressing wheel for performing dressing to a grinding face of the grinding wheel and a rotary supporting face of the regulating wheel, wherein the single dressing wheel comprises a rotary dresser having a profile fit for the grinding face of the grinding wheel and the rotary supporting face of the regulating wheel.

4. A dressing device for a centerless grinding machine as defined in claim 3, wherein the rotary dresser is in the form of a diamond roll and is realized by integrally forming dressing parts having a profile fit for the grinding face of the grinding wheel and wherein the rotary supporting face of the regulating wheel and a spindle part constituting the rotary supporting face of the rotary dresser.

5. A dressing device for a centerless grinding machine as defined in claim 3, wherein the grinding wheel and the regulating wheel and the rotary dresser of the single dressing wheel are constructed in a way to be relatively movable in a radial feed direction of said grinding wheel.

6. A dressing device for a centerless grinding machine as defined in claim 3, wherein the grinding wheel is fixedly provided in a radial feed direction while the regulating wheel is constructed in a way to be movable in the radial feed direction, the single dressing wheel is provided above the grinding wheel while the rotary dresser is provided in a way to be movable in the radial feed direction.

7. A dressing device for a centerless grinding machine as defined in claim 3, wherein the single dressing wheel is disposed and supported, together with a blade supporting a work, on a slide base provided between the grinding wheel and the regulating wheel, the slide base being movable in a direction parallel to an axial line of the grinding wheel and the regulating wheel, wherein use of the dressing wheel and the blade is selectively enabled.

8. A dressing device for a centerless grinding machine as defined in claim 7, wherein a position switcher is provided for switching an arrangement of the single dressing wheel and the blade, the position switcher comprises the slide base and a feed screw unit for moving the slide base, the slide base is made movable, between said grinding wheel and said regulating wheel, forward and backward in the direction parallel to the axial line of said grinding and regulating wheels, the single dressing wheel and the blade being disposed and supported on the slide base at prescribed intervals, and the slide base moves forward and backward in a prescribed range by means of the feed screw unit, to selectively dispose the single dressing wheel and the blade in a working state.

9. A dressing device for a centerless grinding machine as defined in claim 8, wherein an axial line of the work supported on the blade and an axial line of the rotary dresser of the single dressing wheel are positioned on one same horizontal plane.

10. A dressing device for a centerless grinding machine as defined in claim 9, wherein a height of a shaft center of the work and of the rotary dresser is set at a same height as a shaft center of the grinding wheel and the regulating wheel.

11. A dressing device for a centerless grinding machine as defined in claim 3, wherein the single dressing wheel is provided in the centerless grinding machine for performing radial feed grinding to a non-cylindrical outer-circumferential surface of a work which is rotatably supported at a grinding position.

12. A dressing device for a centerless grinding machine as defined in claim 11, wherein the centerless grinding machine, designed for performing centerless grinding of double conical surfaces of conical rollers rotatably supported at the grinding position, comprises the grinding wheel having the grinding face of a profile suitable for a double conical face of th conical rollers, the regulation wheel having the rotary supporting face of a profile suitable for the double conical face of the conical rollers, a blade having a supporting face for supporting the double conical face of the conical rollers in such a way that an axial line of the grinding wheel becomes parallel to an axial line of a center axial line of rotation of the conical rollers, and the single dressing wheel for performing dressing to the grinding face of the grinding wheel and the rotary supporting face of the regulating wheel, wherein the single dressing wheel comprises a rotary dressers having a profile fit for said grinding face of the grinding wheel and the rotary supporting face of the regulating wheel, and a driving motor for rotating and driving the rotary dresser.

13. A dressing device for a centerless grinding machine as defined in claim 12, wherein the supporting face of the blade has a V-shaped profile along a ridgeline of the double conical faces of the conical rollers.

14. A dressing device for a centerless grinding machine as defined in claim 12, wherein said centerless grinding machine, is for performing centerless grinding of the double conical surfaces of the conical rollers rotatably supported at the grinding position, and the grinding face of the grinding wheel, the rotary supporting face of the regulating wheel and the supporting face of the blade have a profile suitable for the double conical face of plural number of conical rollers aligned in a direction of said center axial line of rotation of the conical rollers.

15. A dressing device for a centerless grinding machine as defined in claim 12, wherein said centerless grinding machine comprises a loader unit for loading and unloading the conical rollers to and from said grinding position, and a control system for driving and controlling respective drive sources of the grinding wheel, the regulating wheel, the loader unit and the dressing device interlocking with one another.

* * * * *